US008419401B2

(12) United States Patent
McMahon et al.

(10) Patent No.: US 8,419,401 B2
(45) **Date of Patent: *Apr. 16, 2013**

(54) METHOD AND DEVICE FOR DISPENSING SEALANT WITHIN A GAP

(75) Inventors: Michael J. McMahon, Palatine, IL (US); Stanely Piotrowski, Addison, IL (US); George Mathew Davis, Chicago, IL (US); Anthony Caringella, Norridge, IL (US); Kyle Kestner, Schaumburg, IL (US); Donald L. VanErden, Wildwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 104 days.

This patent is subject to a terminal disclaimer.

(21) Appl. No.: 12/582,554

(22) Filed: Oct. 20, 2009

(65) Prior Publication Data

US 2011/0091590 A1 Apr. 21, 2011

Related U.S. Application Data

(60) Provisional application No. 61/151,842, filed on Feb. 12, 2009.

(51) Int. Cl.
*B65D 25/40* (2006.01)

(52) U.S. Cl.
USPC ..... 425/87; 425/182; 425/458

(58) Field of Classification Search ..... 425/87, 425/318, 458, 461, 182; 222/82, 537, 567, 222/569, 570, 575; 401/267; 156/579
See application file for complete search history.

(56) References Cited

U.S. PATENT DOCUMENTS

| | | | | |
|---|---|---|---|---|
| 721,168 | A | 2/1903 | Egbert | |
| 845,530 | A * | 2/1907 | Davis | 425/87 |
| 1,142,022 | A * | 6/1915 | Chappell | 425/87 |
| 2,205,604 | A | 6/1940 | Sherbondy | |

(Continued)

FOREIGN PATENT DOCUMENTS

| | | | |
|---|---|---|---|
| FR | 2653056 | A1 * | 4/1991 |
| WO | 2005/113907 | | 12/2005 |
| WO | 2007/133096 | | 11/2007 |
| WO | WO 2008041860 | A1 * | 4/2008 |

OTHER PUBLICATIONS

USPTO (International Searching Authority), International Search Report & Written Opinion; Mar. 19, 2010.
USPTO (International Searching Authority), International Search Report &Written Opinion for PCT/US2010/021132; May 20, 2010.

(Continued)

*Primary Examiner* — Dimple Bodawala
(74) *Attorney, Agent, or Firm* — Klintworth & Rozenblat IP LLC

(57) ABSTRACT

A nozzle head for dispensing sealant within a gap is provided. The nozzle head includes, but is not limited to, a body section and a port connected with the body section. The body section forms a primary channel through which sealant is dispensed. The primary channel forms an entrance through which sealant enters the body section and an exit through which sealant is dispensed from the nozzle. The port is connected with the body section and surrounds the exit. The port forms a chamber having a tip portion opposed to a rear opening. The chamber forms an angled path from the tip portion to the rear opening to trap and guide excess sealant within the chamber to the rear opening.

13 Claims, 17 Drawing Sheets

U.S. PATENT DOCUMENTS

| | | | | | |
|---|---|---|---|---|---|
| 2,522,324 | A | * | 9/1950 | Wilkerson | 401/183 |
| 2,587,683 | A | | 3/1952 | Barry | |
| 2,824,443 | A | * | 2/1958 | Ames | 425/87 |
| 3,087,654 | A | | 4/1963 | Moore | |
| 3,130,872 | A | | 4/1964 | Myers et al. | |
| 3,193,146 | A | | 7/1965 | Isgriggs et al. | |
| 3,279,971 | A | | 10/1966 | Gardener | |
| 3,334,792 | A | * | 8/1967 | Piencinski et al. | 425/87 |
| 3,559,234 | A | * | 2/1971 | Clark | 425/182 |
| 3,653,560 | A | | 4/1972 | Adams et al. | |
| 3,953,006 | A | * | 4/1976 | Patarcity et al. | 366/81 |
| 4,260,273 | A | | 4/1981 | Hemperly, Jr. et al. | |
| 4,453,651 | A | | 6/1984 | Braithwaite et al. | |
| 4,461,454 | A | | 7/1984 | Vadnais | |
| 4,570,834 | A | | 2/1986 | Ward | |
| 4,946,081 | A | * | 8/1990 | Jacobson | 222/568 |
| 4,957,225 | A | | 9/1990 | Childers | |
| 4,981,629 | A | | 1/1991 | Cook | |
| 5,010,618 | A | * | 4/1991 | Croft | 15/235.7 |
| 5,017,113 | A | | 5/1991 | Heaton et al. | |
| 5,033,951 | A | | 7/1991 | Cook | |
| 5,046,877 | A | | 9/1991 | Longo | |
| 5,249,876 | A | | 10/1993 | Hattman | |
| 5,429,273 | A | | 7/1995 | King et al. | |
| 5,560,521 | A | | 10/1996 | Boring et al. | |
| 5,775,551 | A | | 7/1998 | Tordsen | |
| 6,155,809 | A | * | 12/2000 | Edwards et al. | 425/87 |
| 6,892,904 | B2 | | 5/2005 | Osborn et al. | |
| 7,246,402 | B2 | * | 7/2007 | Washburn | 15/235.7 |
| 7,674,059 | B2 | * | 3/2010 | Daigle | 401/48 |
| 2001/0030207 | A1 | * | 10/2001 | Wemyss et al. | 222/567 |
| 2003/0072830 | A1 | * | 4/2003 | Conboy et al. | 425/87 |
| 2003/0178446 | A1 | * | 9/2003 | Osgood | 222/327 |
| 2003/0222160 | A1 | | 12/2003 | Gordon | |
| 2005/0106278 | A1 | * | 5/2005 | Hall et al. | 425/87 |
| 2008/0264981 | A1 | * | 10/2008 | Hjort | 222/533 |
| 2010/0239705 | A1 | * | 9/2010 | Jorstad et al. | 425/461 |
| 2010/0278958 | A1 | * | 11/2010 | Chamberlain et al. | 425/458 |
| 2011/0089192 | A1 | * | 4/2011 | McMahon et al. | 222/82 |

OTHER PUBLICATIONS

Office Action mailed Apr. 5, 2012.

* cited by examiner

METHOD AND DEVICE FOR DISPENSING SEALANT WITHIN A GAP

CROSS-REFERENCES TO RELATED APPLICATIONS

The Present Application claims the benefit of U.S. Provisional Patent Application No. 61/151,842, filed Feb. 12, 2009. The content of this U.S. Provisional patent application is hereby incorporated herein in its entirety.

FIELD OF THE INVENTION

The present invention relates to nozzles. More specifically, it relates to a method and device for dispensing sealant within a gap.

BACKGROUND

Traditionally, sealants such as caulk are applied within a seam, gap, or joint as way to fill the gap. However, with certain applications, some issues may arise. For example, in one known method for applying a sealant, such as sound control sealant (SCS), an operator uses a hand-gun containing a cartridge with a straight tip nozzle to apply sealant to fill in a gap, such as a gap formed at the top and bottom of a sheet of drywall, during installation of the drywall.

The straight tip is cut at an angle to form an opening. The angle and diameter of the opening are determined by the operator before cutting the tip and are based on the size of the gap to be filled, since the operator wants to both use the gap to guide the tip and also maximize the amount of sealant pumped into the gap while the operator moves the hand-gun along the length of the gap.

In filling a high gap, for example where drywall meets the ceiling, the operator typically uses a step stool, ladder, or lift in order to bring the straight tip in contact with or near the high gap. In filling a lower gap, for example where drywall meets the floor, the operator typically needs to bend over and drag the hand-gun backward over the lower gap, which makes it difficult to pressure pack the sealant into the lower gap.

Moreover, there is often confusion as to when the sealant should be applied to fill in a gap. For example, during the installation of the drywall, many local codes do not have clear application specifications for the application of SCS in filling gaps between sheets of drywall. Some operators apply the SCS before the drywall sheet is installed, some apply after the drywall sheet is installed, and some apply both before and after the drywall sheet is installed. Additionally, some operators apply the SCS simultaneously during the installation of the drywall sheets and some operators apply the SCS independent of installing the drywall sheet, as long as the SCS has not hardened.

Sometimes upon applying the sealant, for example in cases when the SCS is applied after the drywall sheet is installed, the operator may need to go back to finish a bead of sealant by removing any excess sealant. The operator may use a trowel or tool, such as a caulk finishing tool manufactured by the DAP Co. of Baltimore, Md., to finish and clean-up any excess sealant. This two-step process is rather cumbersome and requires additional time in order to apply and then finish the sealant.

Moreover, when sealant is applied with a straight tip nozzle, it is often difficult to control the amount of sealant applied. The straight tip is often not capable of providing sufficient back pressure against a bead of sealant as the sealant is dispensed through the straight tip. The sealant often comes out of the straight tip at atmospheric pressure and flows freely into and out of the gap, which is the path of least resistance. Typically, the sealant will not compress deep into the gap, since this is a path of more resistance.

Sometimes, when applied using a straight tip, the sealant results in a partially filled gap with a curtain of sealant at the mouth of the gap, which may only lightly attach to the top of the gap. If air tight, then this thin curtain of sealant may not be sufficient for sealing the gap. For example, in some applications the thin curtain may reflect but not absorb sound because of its low mass. Over time, the thin curtain of sealant may slump or sag due to its own weight and viscosity conditions, along with a lack of pressure adherence in the area at which the sealant hangs from at the top of the gap. Additionally, the sealant may shrink a certain amount over time due to temperature changes or variations in moisture. The slump and shrinkage of sealant within a partially filled gap may cause an air gap or opening in the gap to occur, which allows for the direct transmission through the gap, such as the transmission of sound waves through the gap.

Sometimes, when an operator is applying sealant with a straight tip, the hand-gun is often dragged away from the bead of sealant and a pulling or stringing of the bead may occur which may cause a discontinuous bead with air paths along the top surface of the bead. In all methods for applying sealant in which a straight tip is used, the operator may have difficulty visually sensing if the gap is sealed and filled with sealant because the operator may not be able to see the back side of the bead of sealant, in addition to possibly having difficulty seeing the front of the bead of sealant. This may result in the improper application of sealant within the gap, requiring the sealant to be reapplied at a significant expense, in order to pass testing, such as sound testing for SCS.

The application of sealant may require a second step for finishing or clean-up of excess sealant. While filling the gap with sealant from a straight tip, the sealant often under-fills or over-fills the gap, resulting in a poor finished look. The sealant may spill out of the gap and make an unsightly mess, which should be wiped off, resulting in time lost and extra cost associated with having an operator back track and going over a bead of sealant a second time. This not only results in two steps, but also results in excess sealant being applied and thus having to be disposed of.

Additionally, the two-step process typically does not work well when using a long hose or tube assembly, known as a "wand," attached to a bulk backpack dispenser for dispensing sealant. For example, the wand is often used to apply sealant to seal a gap located at a height which is difficult for the operator to reach with his hands. Therefore, in order to perform the finishing step, the operator would then have to use a ladder or chair to reach the sealant within the gap and finish the bead of sealant.

As a result, it would be desirable to have a one-step process wherein the sealant is applied and finished in a single operation. Additionally, it would also be desirable to apply the sealant in a way which minimizes or at least reduces the amount of excess sealant within a gap, thereby reducing or eliminating the need for a finishing step. Additionally, it would also be desirable for the operator to be able to visually sense if the gap is sealed and filled with sealant.

SUMMARY

In one aspect, a nozzle head for dispensing sealant within a gap is provided. The nozzle head includes, but is not limited to, a body section and a port connected with the body section. The body section forms a primary channel through which sealant is dispensed. The primary channel forms an entrance through which sealant enters the body section and an exit through which sealant is dispensed from the nozzle. The port is connected with the body section and surrounds the exit. The port forms a chamber having a tip portion opposed to a rear opening. The chamber forms an angled path from the tip portion to the rear opening to trap and guide excess sealant within the chamber to the rear opening.

In one aspect, a nozzle for dispensing sealant within a gap in an application direction is provided. The nozzle includes, but is not limited to, a body section, a port connected with the body section, and a nose. The body section forms a primary channel through which sealant is dispensed in a dispensation direction. The primary channel forms an entrance through which sealant enters the body section and an exit through which sealant is dispensed from the nozzle. The port is connected with the body section and surrounds the exit. The port forms a chamber having a tip portion opposed to a first rear opening. The chamber traps excess sealant at the tip portion and guides excess sealant to the first rear opening. The nose is connected with the body section located a first distance from the exit, opposite the application direction and along the dispensation direction. The nose includes a first surface for bridging at least a portion of the gap and guiding sealant into the gap.

In one aspect a sealant container is provided. The sealant container includes, but is not limited to, a housing and a nozzle. The housing contains sealant and has a top surface opposed to a bottom surface. The nozzle is connected with the top surface of housing. The nozzle includes, but is not limited to, a body section, a port, and a base portion. The body section forms a primary channel through which sealant is dispensed. The primary channel forms an entrance through which sealant enters the body section and an exit through which sealant is dispensed from the nozzle. The port is connected with the body section and surrounds the exit. The port forms a chamber having a tip portion opposed to a first rear opening. The chamber traps excess sealant at the tip portion and guides excess sealant to the first rear opening. The base portion is coupled at one end with the body section and at an opposing end with the top surface of the housing. The base portion forms a secondary channel which extends into the housing and is in fluid communication with the primary channel and with the sealant within the housing.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Figure 1:
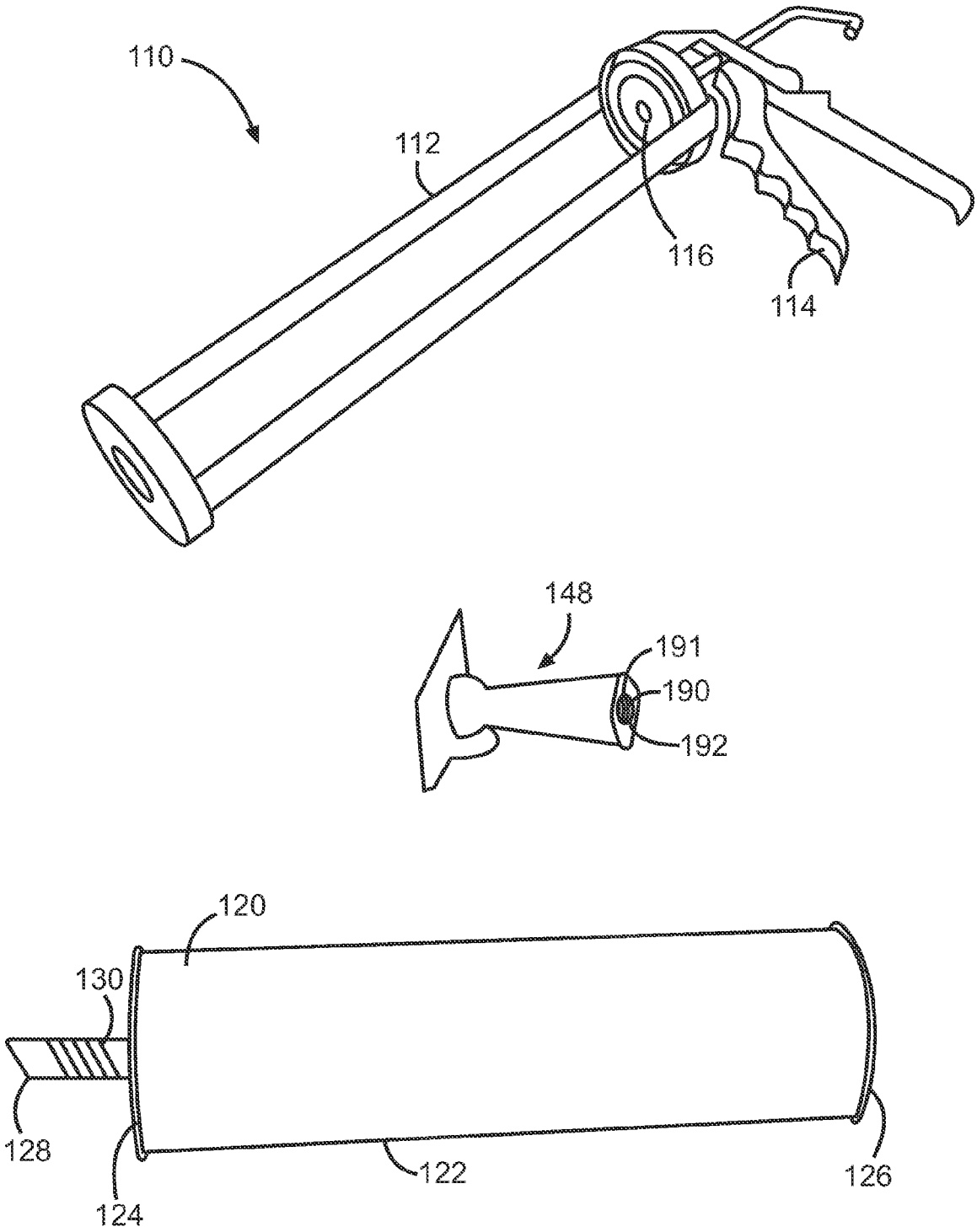
FIG. 1 depicts a perspective view of a sealant container, a nozzle disassembled from the sealant container, and a sealant applicator having a chamber for receiving the sealant container, in accordance with one embodiment of the present invention.
Figure 2:
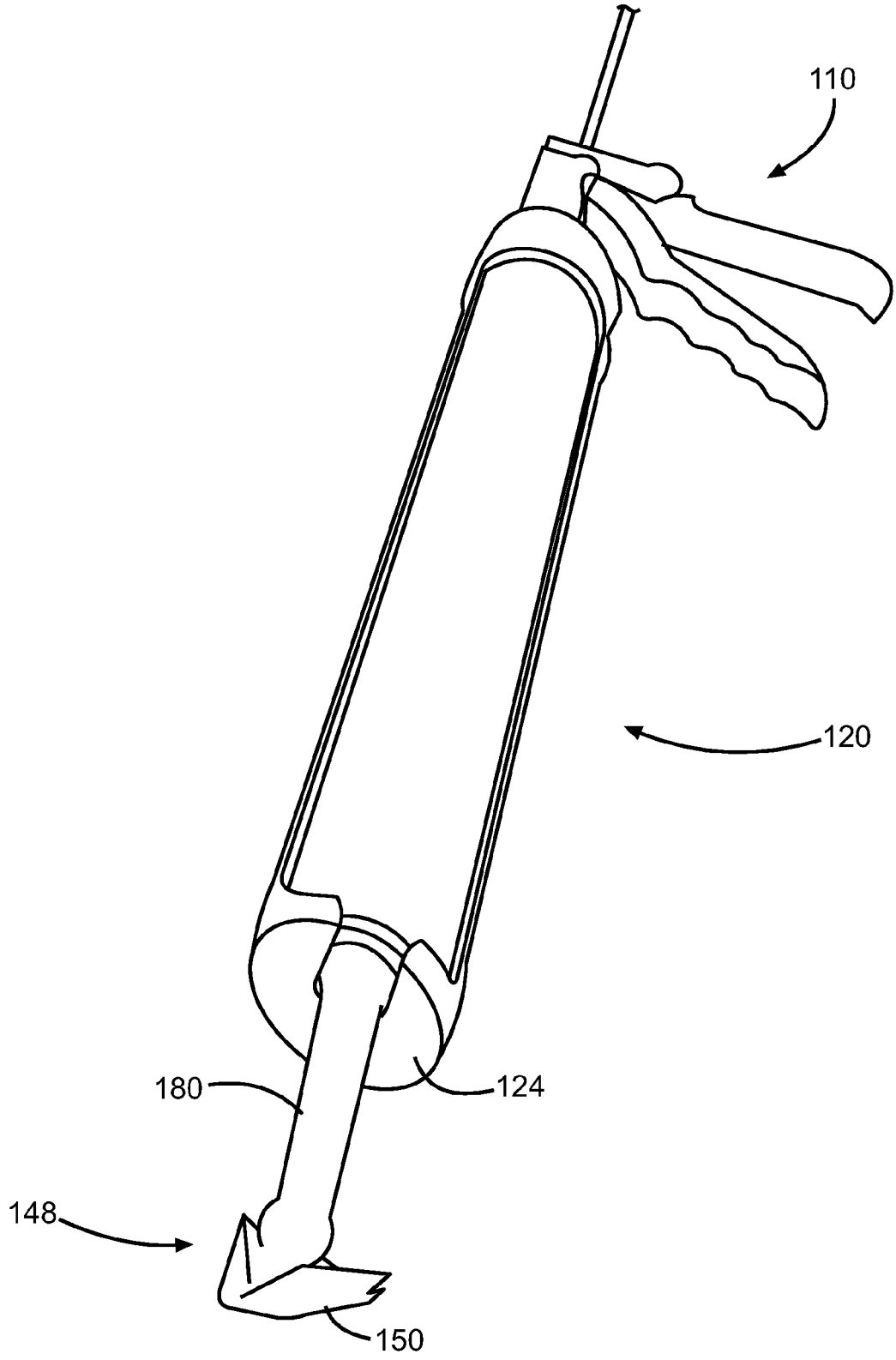
FIG. 2 depicts a perspective view of a sealant container within a chamber of a sealant applicator and a nozzle assembled to the sealant container, in accordance with one embodiment of the present invention.
Figure 5:
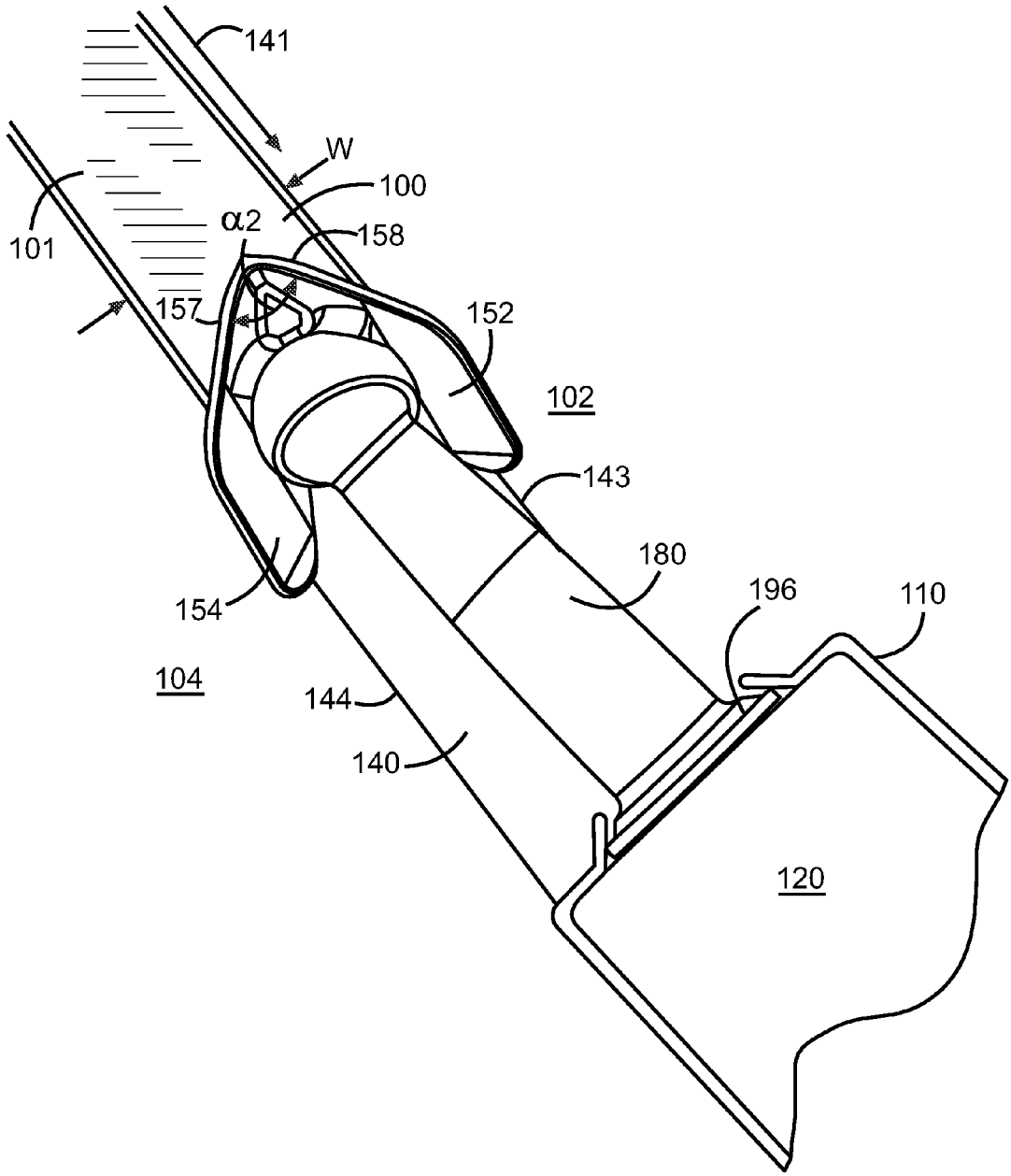
FIG. 5 depicts a rear perspective view of the nozzle shown in FIG. 3, where the nozzle head is applying sealant within a gap, in accordance with one embodiment of the present invention.

Referring to FIGS. 1 and 2, there is shown a nozzle 148 for dispensing sealant 100, a sealant container 120 adapted to receive the nozzle 148, and a sealant applicator 110 adapter to receive the sealant container 120. In one embodiment, the sealant container 120 includes the nozzle 148, in another embodiment, the nozzle 148 is separate and apart from the sealant container 120. Sealant 100 is preferably a viscous material that changes state to become solid, once applied, and is used to prevent the penetration of air, gas, noise, dust, fire, smoke, or liquid from one location through a barrier into another. Referring to FIG. 5, sealant 100 may be used to close an opening such as gap 140 formed between first and second members 102, 104. Sealant 100 may include any type of sealant such as acrylic based sealants, acoustic sealants, adhesive sealants, aerospace sealants, aircraft sealants, aquarium sealants, butyl rubber based sealants, car sealant, construction sealants, dental sealants, elastic sealants, electronic sealants, epoxy sealants, extruded sealants, joint sealants, latex based sealants, marine sealants, plastic sealant, polysulfide sealant, or silicone based sealant. Sealant 100 is stored in sealant container 120 and extruded through nozzle 148 using the sealant applicator 110. Preferably, sealant 100 is a silicone based sealant such as caulk, which is extruded through nozzle 148 using the sealant applicator 110.

Referring to FIGS. 1 and 2, sealant container 120 includes a housing 122 containing sealant 100. Preferably the housing 122 is cylindrically shaped and has a top surface 124 opposed to a bottom surface 126. Preferably, the housing 122 is manufactured from a polymeric material in order to reduce cost. The sealant container 120 includes a second fastener 128, which mates with a first fastener 190 of the nozzle 148. Preferably, the second fastener 128 includes threads 130 which mate with threads 192 of the first fastener 190. In one embodiment, the sealant container 120 includes housing 122 and nozzle 148.

Referring to FIGS. 1 and 2, sealant applicator 110 includes a chamber 112 adapted to received the sealant container 120, a compression member 116 for applying pressure to the bottom surface 126 of the sealant container 120, and a trigger 114 for advancing the compression member 116 and extruding sealant 100 from the sealant container 120.

Referring to FIGS. 3, 4A, 4B, and 5, nozzle 148 dispenses and guides sealant 100 within gap 140 along an application direction 141. Preferably, nozzle 148 is injection molded and formed from a solid material, such as plastic, metal, or an elastomeric material such as rubber, and more preferably, an injection molding resin. In one embodiment, nozzle 148 includes a nozzle head 150 connected with a base portion 180. Preferably, the nozzle head 150 and the base portion 180 are formed as two separate pieces which are later connected with each other. However, the nozzle head 150 may be integrally formed as one piece with the base portion 180. If the nozzle head 150 and base portion 180 are integrally formed as one piece, then preferably, a flexure is formed between the nozzle head 150 and the base portion 180, allowing the nozzle head 150 to move relative to the base portion 180. In this case, the nozzle 148 would preferably be molded from an elastomeric material instead of a typical injection molding resin.

In either case the nozzle 148 is designed to be a high volume low cost molded product with a material weight of approximately 20 grams, ±5 grams, for a typical nozzle 148. The nozzle 148 is preferably reusable and/or transferable to another sealant container 120, but the low cost of manufacture also allows the nozzle 148 to be disposable, if desired.

Figure 4A:
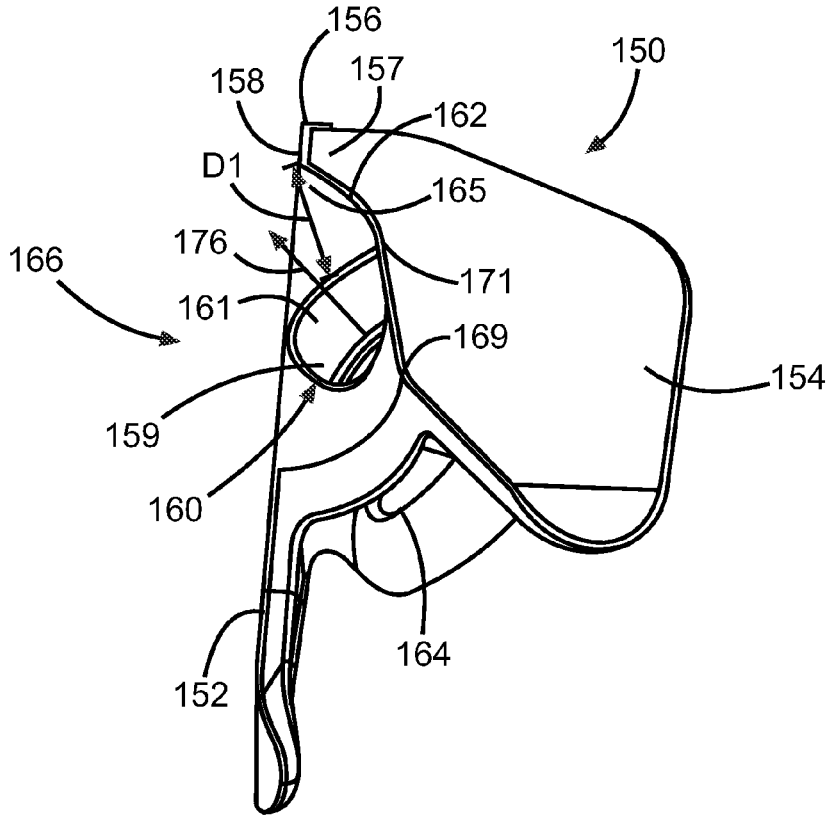
FIG. 4A depicts a front perspective view of the nozzle head shown in FIG. 3, in accordance with one embodiment of the present invention.
Figure 4B:
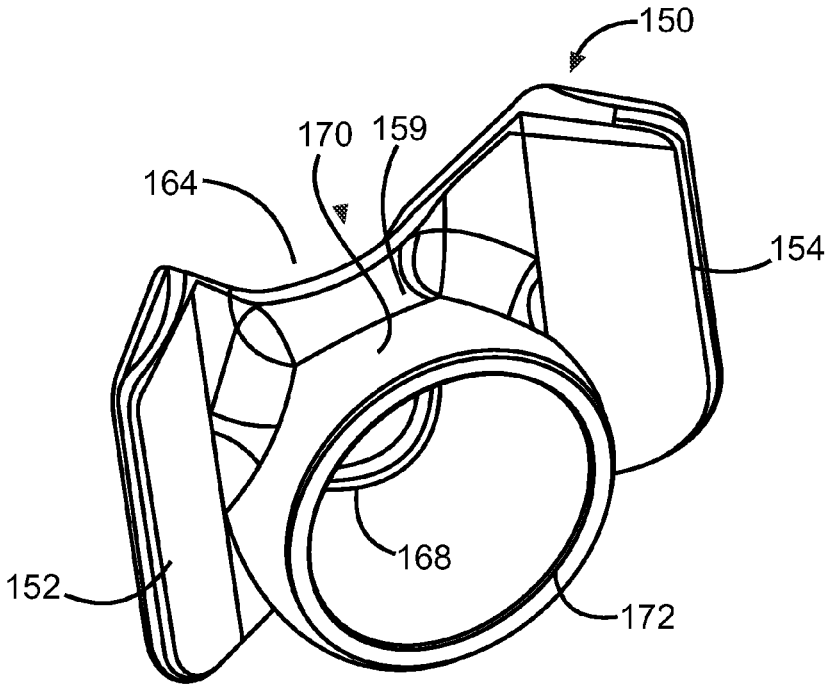
FIG. 4B depicts a rear perspective view of the nozzle head shown in FIG. 3, in accordance with one embodiment of the present invention.

Referring to FIGS. 4A and 4B, nozzle head 150 includes a body section 159, a nose 156 connected with the body section 159, and a first port 160. The body section 159 forms a primary channel 161 through which sealant 100 is dispensed along a dispensation direction 176. The primary channel 161 forms an entrance 168 through which sealant 100 enters the body section 159 and an exit 169 through which sealant 100 is dispensed from the nozzle 148.

Referring to FIG. 4A, nose 156 is connected with the body section 159 adjacent the tip portion 165. Preferably, the nose 156 is located a first distance $D_1$ from the exit 169. Preferably, nose 156 is located distance $D_1$ away from exit 169 in a direction opposite the application direction 141 and along the dispensation direction 176.

Referring to FIG. 5, the nose 156 includes at least a first surface 157 for bridging at least a portion of the gap 140 and guiding sealant 100 into the gap 140. The first surface 157 can take on any one of a variety of shapes, such as flat, convex or concave in order to affect the contour of the surface 101 of the sealant 100.

In one embodiment, nose 156 includes a second surface 158 connected with the first surface 157. The second surface 158 also is for bridging at least a portion of the gap 140 and guiding sealant 100 into the gap 140. The second surface 158 is at a first angle $\alpha_1$ with respect to the first surface 157, the first angle $\alpha_1$ being measured from the first surface 157 to the second surface 158, as shown in FIG. 5. Preferably, the first angle $\alpha_1$ is between 10 and 180 degrees, more preferably between 30 and 120 degrees, and most preferably between 70 and 100 degrees. In one embodiment, the first angle $\alpha_1$ is approximately 90 degrees, ±5 degrees.

Nose 156 extends down and contacts the surface 101 of sealant 100 within the gap 140. The nose 156 acts as a backstop to prevent sealant 100 from flowing out of the gap 140 and onto members 102, 104 and to help increase the hydrostatic pressure of the sealant 100 within the gap 140. Increasing the hydrostatic pressure of the sealant 100 within the gap 140 helps to insure that sealant fills the opening formed by gap 140. When new sealant 100 flows into the gap 140, the surface 157 of the nose 156 helps trap the sealant 100 and force the sealant 100 to flow down into the gap 140 and fill gap 140 with sealant 100.

The first port 160 is connected with the body section 159 and surrounds the exit 169. The first port 160 forms a chamber 171 having a tip portion 165 opposed to a first rear opening 164. The chamber 171 is designed to control the flow of sealant into the gap by using an angled path 162 to trap excess sealant 100 at the tip portion 165 and guide excess sealant 100 to the first rear opening 164. The angled path 162 is preferably cupped and curves up and away from the exit 169 in a direction that is both opposite the application direction 141 and along the dispensation direction 176, preferably ending at the tip portion 165. The angled path 162 and the tip portion 165 help to trap and prevent excess sealant 100 from entering gap 140. The angle path 162 also forces the sealant 100 to flow toward the front of the gap 140 until the gap 140 under the nozzle 148 is full of sealant 100, as shown in FIG. 5. Once the gap 140 us full of sealant 100, the chamber 171 fills with sealant 100 and allows the sealant 100 to flow toward the rear opening 164. The rear opening 164 is located below the exit 169, in the application direction 141, and opposed to the tip portion 165. Since the rear opening 164 and rear of the gap 140 are both open to the atmosphere, and at approximately atmospheric pressure, any excess sealant 100 will eventually flow out of the nozzle 148 through the rear opening 164 after the gap 140 is full of sealant 100.

The appearance of sealant 100 flowing out of the nozzle 148 at the rear opening 164 provides an operator with a visual indicator that the gap 140 under the nozzle 148 is full of sealant 100. When an operator sees sealant 100 flowing out of rear opening 164, it should guide the operator to drag the nozzle 148 more quickly in the application direction 141 toward a section of gap 140 that needs to be filled with sealant 100. As this occurs, the nozzle 148 will also be dragged over areas of the gap 140 which have been previously filled with sealant 100, causing the sealant 100 to be pressed and compacted into the gap 140 and smoothed and finished by the surface of the nose 156.

Referring to FIGS. 3, 4A, 4B, and 5, in one embodiment, the nozzle head 150 includes first and second wings 152, 154 extending from opposing sides of the nose 156 and port 160 for bridging the gap 140. Preferably, first and second wings 152, 154 are shaped and sized to bridge and cover the entire width W of the gap 140 and help center the nozzle head 150, and preferably the exit 169 of the primary channel 161, over the gap 140. The first and second wings 152, 154 help center the nozzle head 150 even if the width W of the gap 140 varies. The span of the first and second wings 152, 154 allows them to bridge gaps 140 having a variety of widths W without needing any adjustment to fill the gap 140 with sealant 100. By covering the gap 140, first and second wings 152, 154 act as a backstop to prevent sealant 100 from flowing out of the gap 140, to force the sealant 100 to stay in the gap 140, and to flow sealant 100 deep into the gap 140. For example, when the gap 140 is filled with sealant 100, hydrostatic pressure of sealant 100 within the gap 140 increases and the sealant 100 is forced deep into any cracks or openings within the gap 140 and between first and second members 102, 104. The hydrostatic pressure forces the sealant 100 is deep into any cracks or openings within the gap 140 regardless of whether the first and second members 102, 104 are portions of a ceiling, a wall, or a floor. Preferably, the first and second wings 152, 154 sealingly engage first and second members 102, 104 so as to increase the hydrostatic pressure of sealant 100 within the gap 140 and to prevent any sealant 100 from exiting the gap 140 through sidewalls 143, 144 of the gap 140.

Figure 6:
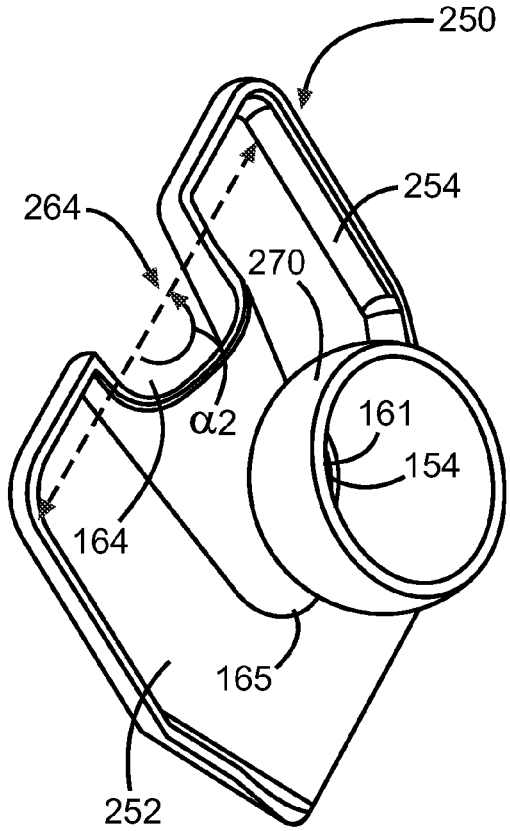
FIG. 6 depicts a rear perspective view of a nozzle head having wings which are approximately 180 degrees from each other, in accordance with one embodiment of the present invention.

Referring to FIGS. 5 and 6, first and second wings 152, 154 can be formed at various engagement angles $\alpha_2$ with respect to each other, often depending on the angles between first and second members 102, 104. In one embodiment, first wing 152 extends in a first plane and the second wing 154 extends in a second plane. An engagement angle $\alpha_2$ is formed between the first and second planes. Preferably, the engagement angle $\alpha_2$ is measured as the angle formed between the first and second planes which is less than 180 degrees. Preferably, the engagement angle $\alpha_2$ is between 10 degrees and 180 degrees, more preferably between 30 and 120 degrees, and most preferably between 70 and 100 degrees. Referring to FIG. 5, in one embodiment, the engagement angle $\alpha_2$ is approximately 90 degrees, ±5 degrees, for engaging first and second members 102, 104 which are approximately at right angles with respect to each other. Referring to FIG. 6, in one embodiment, the engagement angle $\alpha_2$ is approximately 180 degrees, ±5 degrees, for engaging first and second members 102, 104 which are at approximately parallel to each other.

For curved or round members 102, 104, first and second wings 152, 154 can be at approximately 180 degrees, ±5 degrees from each other and curved so as to match the curvature of the round members 102, 104. For example, curved first and second wings 152, 154 may be used to apply sealant to a gap 140 around pipe holes, In use, the nozzle head 150, and specifically first and second wings 152, 154, are pressed against first and second members 102, 104, respectively, and sealant 100 is forced out through exit 169 of primary channel 161 and into gap 140. First and second wings 152, 154 help to keep surfaces of first and second members 102, 104 clean and also smooth the surface 101 of sealant 100 within the gap 140, to provide a finished bead of sealant 100. By keeping surfaces of first and second members 102, 104 clean, and by smoothing the surface 101 of the sealant 100, first and second wings 152, 154 allow nozzle head 150 to both apply sealant 100 within a gap 140 and finish a bead of sealant 100 both at the same time. Additionally, port 160 also helps nozzle head 150 to both apply sealant 100 within a gap 140 and finish a bead of sealant 100 both at the same time, by trapping any excess sealant 100 and guiding it to rear opening 164, providing the operator with an indicator that too much sealant 100 is being applied to the gap 140. As a result, nozzle 148 allows an operator to apply a finished bead of sealant 100 all in one motion as the nozzle head 150 is dragged along the gap 140. Any secondary finishing or cleanup is either reduced or eliminated by using nozzle 148.

Figure 7:
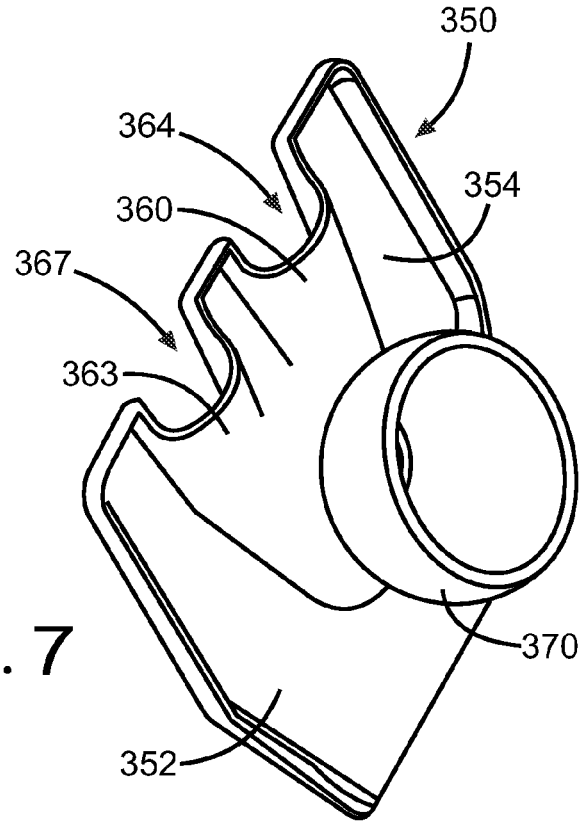
FIG. 7 depicts a rear perspective view of a nozzle head having first and second ports, in accordance with one embodiment of the present invention.

Referring to FIG. 7, in one embodiment, a nozzle head 350 is provided which includes a first port 360 and a second port 363 with first and second rear openings 364, 367, respectively. The nozzle head 350 also includes wings 352, 354 which extend from ports 363, 360, respectively. The additional port 363 provides an additional opening 367 which allows for more excess sealant 100 to flow through. Nozzle head 350 may also have more than two ports.

Figure 3:
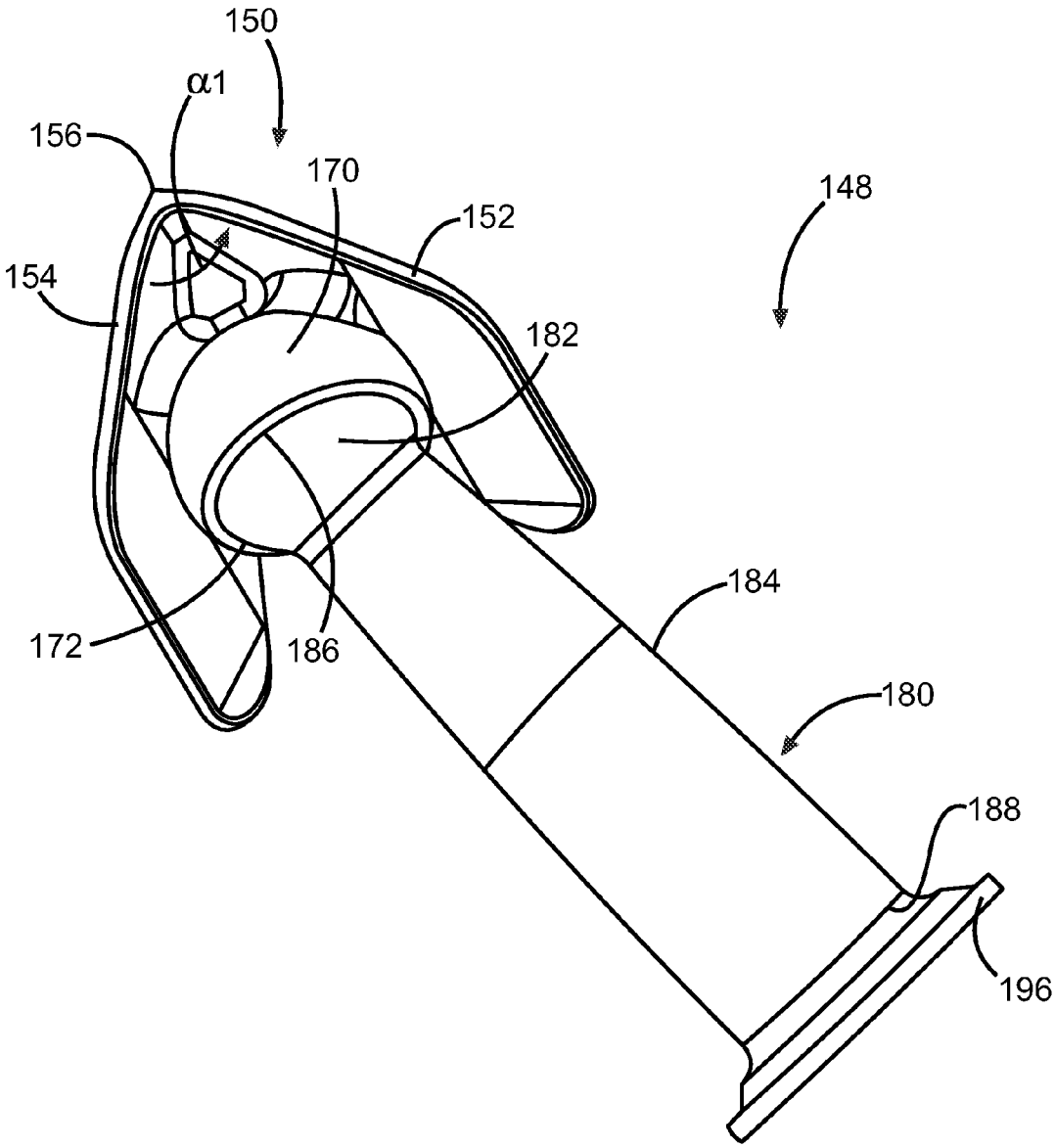
FIG. 3 depicts a rear perspective view of a nozzle having a nozzle head movably connected with a base portion, in accordance with one embodiment of the present invention.
Figure 10:
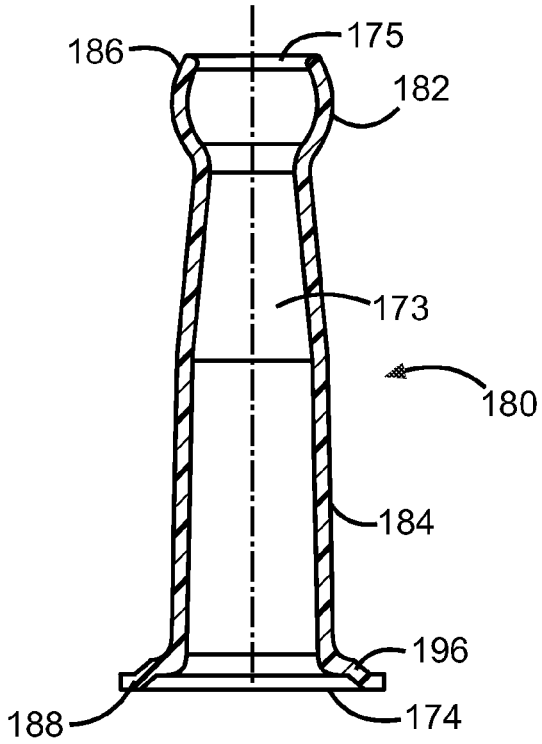
FIG. 10 depicts a cross-sectional view of the base portion shown in FIG. 9 along line 1-1, in accordance with one embodiment of the present invention.

Referring to FIGS. 3 and 10, base portion 180 is coupled with the body section 159 and includes a housing 184 which forms a secondary channel 173 which is in fluid communication with the primary channel 161. The secondary channel 173 forms an entrance 174 through which sealant 100 enters the base portion 180 from the sealant container 120 and an exit 175 through which sealant 100 exits the secondary channel 173 and enters the primary channel 161. The base portion 180 includes a top end 186 opposed to a bottom end 188, where the entrance 174 is at the bottom end 188 and the exit 175 is at the top end 186. The bottom end 188 of the base portion 180 can be sized to fit either a sealant applicator 110 such as a hand gun or a wand of a bulk dispenser.

Referring to FIG. 3, preferably the base portion 180 is movably coupled with the body section 159. In one embodiment, the body section 159 comprises a first coupler 170 surrounding the entrance 168 to the primary channel 161 and the base portion 180 comprises a second coupler 182 surrounding the exit 175 of the secondary channel 173. Preferably, the first coupler 170 matingly engages the second coupler 182. First and second couplers 170, 182 may include any type of device adapted to connect with another device, and includes such thing as: mechanical fasteners including hook and loop type fasteners such as VELCRO™ projecting members such as keys, channels and cavities such as key-holes, snap-fit arrangements, a frictional arrangement which includes members which frictionally engage each other, screws, nails, nuts and bolts, ball joints and sockets, and hydraulic engagement; chemical fasteners such as epoxy or other types of glue, and solder or other types of welding engagements; magneto-electrical fasteners such as magnets, electrical magnets, and charged couplings. In one embodiment, the first coupler 170 is a female coupling and the second coupler 182 is a male coupling, however, the first coupler 170 may be a male coupling and the second coupler 182 may be a female coupling. Preferably, the first and second couplings 170, 182 are spherically shaped so as to allow pivotal movement between the body section 159 and the base portion 180.

Referring to FIG. 4B, in one embodiment, first coupler 170 includes a knuckle 172 which allows the nozzle head 150 to tilt and preferably, to rotate. The knuckle 172 allows the operator to hold the sealant container 120 at a variety of angles with respect to the gap 140, yet still allow for the first and second wings 152, 154 to rest flat against the first and second members 102, 104, respectively. Preferably, the knuckle 172 is positioned relative to the first and second wings 152, 154 so that a balance point is formed that ensures that the nozzle head 150 will not tip over and that the first and second wings 152, 154 stay in contact with the first and second members 102, 104 when the nozzle is dragged along the gap 140 and sealant 100 is applied into the gap 140. Preferably, the first coupler 170 is removably coupled to the second coupler 182, so that the nozzle head 150 may be detached from the base portion 180. By being removably coupled to the second coupler 182, the first coupler 170 allows for the nozzle head 150 to be replaced with another nozzle head having a different design depending on the application, or to be cleaned out.

Referring to FIGS. 3, 5, and 10, in one embodiment, the base portion 180 includes a flanged member 196 at the exit 175 of the base portion 180. When the nozzle 148 is connected with the top surface 124 of the sealant container 120, the flanged member 196 acts to reinforce the top surface 124 of the sealant container 120 and to prevent bending of the base portion 180 at the point of attachment for the sealant container 120 and the nozzle 148. Referring to FIG. 5, the sealant container 120 can be loaded in the chamber 112 of the sealant applicator 110 so that the flanged member 196 is trapped between the sealant applicator 110 and the sealant container 120, increasing the bending strength of the base portion 180 during application of sealant 100 to the gap 140.

Referring to FIGS. 1 and 2, the base portion 180 includes a coupling member 191 which fastens the base portion 180 to the sealant container 120. Coupling member 191 may include any type of device adapted to connect with another device, and includes such thing as: mechanical fasteners including hook and loop type fasteners such as VELCRO™, projecting members such as keys, channels and cavities such as keyholes, snap-fit arrangements, a frictional arrangement which includes members which frictionally engage each other such as with a slip fit, screws, nails, nuts and bolts, ball joints and sockets, and hydraulic engagement; chemical fasteners such as epoxy or other types of glue, and solder or other types of welding engagements; magneto-electrical fasteners such as magnets, electrical magnets, and charged couplings. Preferably, coupling member 191 includes a first fastener 190 which engages and mates with a second fastener 128 connected with the top surface 124 of the sealant container 120.

Figure 20:
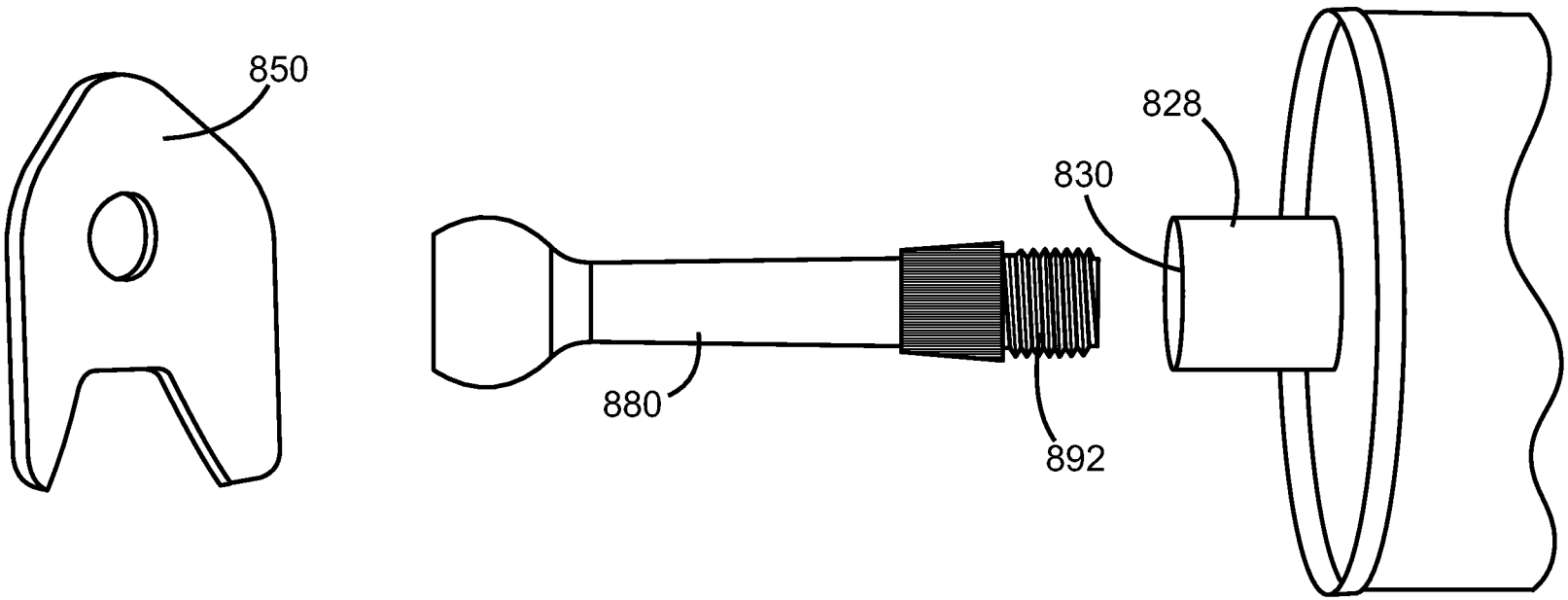
FIG. 20 depicts a side view of a base portion having a coupling member, a nozzle head which may be coupled with a first end of the base portion, and a sealant container which may be coupled with an opposing end of the base portion, in accordance with one embodiment of the present invention.
Figure 21:
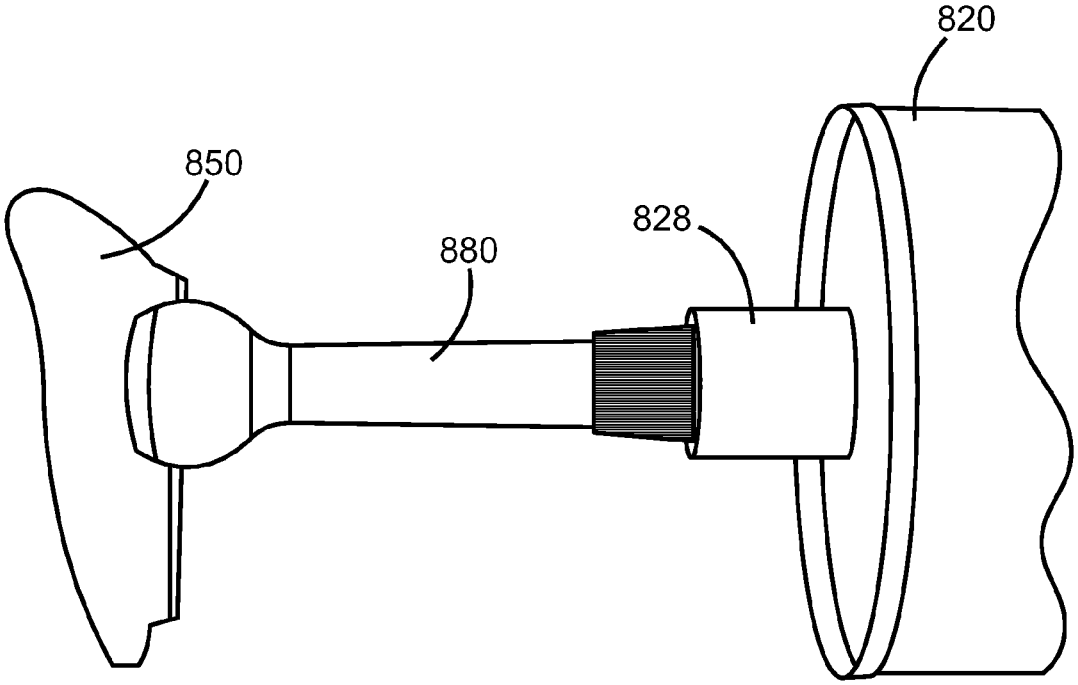
FIG. 21 depicts a side view of the base portion, nozzle head, and sealant container shown in FIG. 20, where the base portion is coupled to the nozzle head at one end and the sealant container at an opposing end.

Coupling member 191 may either permanently fasten the base portion 180 to the sealant container 120, as shown in FIG. 2, or removably fasten the base portion 180 to the sealant container 120, as shown in FIG. 1. Preferably, when coupling member 191 is removably fastened to sealant container 120, first fastener 190 is removably coupled with second fastener 128. Preferably first and second fasteners 128 are either threaded, snap-fit, or hinged connections which mate with each other. Referring to FIG. 1, in one embodiment, first fastener 190 is threaded and therefore includes threads 192 on an inner surface of base portion 180, inside secondary channel 173. Second fastener 128 is also threaded and includes threads 130 on an outside surface of second fastener 128, which mate with threads 192. Referring to FIGS. 20 and 21, first fastener 890 includes threads 892 on an outer surface of base portion 880; second fastener 828 is also threaded and includes threads 130 on an inner surface of second fastener 828, which mate with threads 892.

Figure 8:
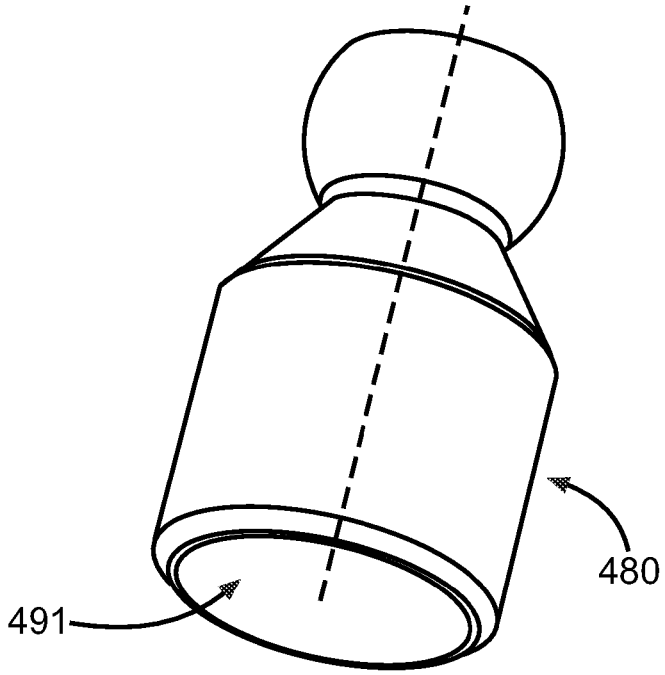
FIG. 8 depicts a side perspective view of a base portion of a nozzle, in accordance with one embodiment of the present invention.
Figure 9:
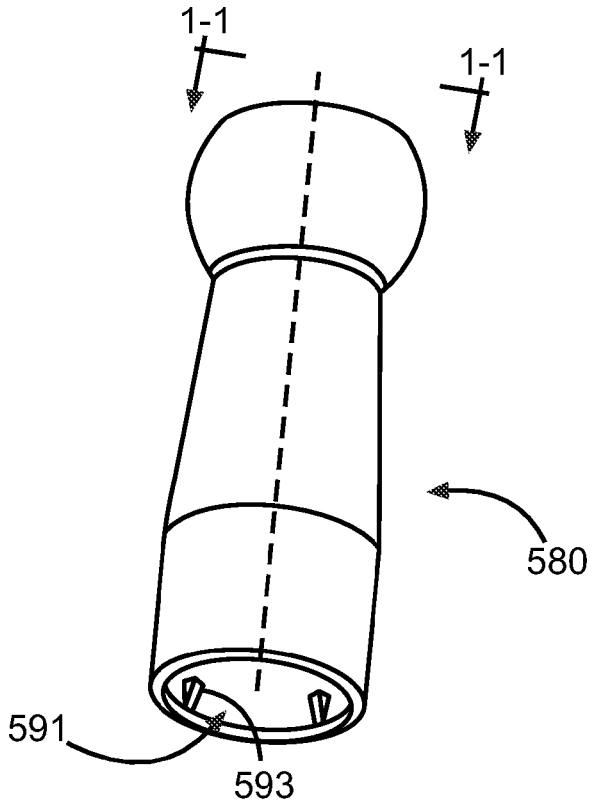
FIG. 9 depicts a side perspective view of a base portion of a nozzle, in accordance with one embodiment of the present invention.

Referring to FIGS. 8 and 9, the base portion 180 can be of various lengths or angles that might be required for better visibility of the nozzle head 150 or for better ergonomics during application of sealant 100. Referring to FIG. 8, a wand base portion 480 is shown for use in applications in which the base portion 480 is connected with the sealant container 120 through a hose or tube assembly (not shown). The wand base portion 480 may connect with the hose or tube assembly (not shown) through a coupling member 491. Referring to FIG. 9, a cartridge base portion 580 is shown for use in applications in which the base portion 580 includes a coupling member 591 which is connected with the sealant container 120 either directly or through a second fastener 128 on the sealant container 120. Preferably, coupling member 491 uses a slip fit arrangement to fasten the base portions 480 to a hose or tube assembly (not shown), where the coupling member 491 is just pressed over hose or tube assembly (not shown). Preferably, coupling member 591 uses a snap fit arrangement having engagement members 593 which engage corresponding members on the sealant container 120 to fasten the base portion 580 to the sealant container 120.

Referring to FIG. 2, in one embodiment, a preformed opening is made through the top surface 124 of the sealant container 120 during manufacture of the sealant container. Then, secondary channel 173 of the base portion 180 is coupled with the sealant container 120, at the preformed opening, allowing for sealant 100 to flow from the sealant container 120, through the preformed opening and into the secondary channel 173. The sealant container 120 is shipped for sale coupled to the base portion 180, and preferably the entire nozzle 148.

Referring to FIG. 1, in one embodiment, the sealant container 120 and the nozzle 148 are shipped for sale together, in a single shipping container, where the nozzle 148 is shipped disassembled from the sealant container 120, and specifically the housing 122. Preferably, the sealant container 120 and the nozzle 148 are shipped for sale together, in a packaging in which the sealant container 120 and the nozzle 148 are eventually sold to an operator. As used herein, an operator is a person who uses the sealant container 120 and nozzle 148, preferably in conjunction with the sealant applicator 110, to apply sealant 100 within gap 140. By shipping the sealant container 120 and the nozzle 148 in a disassembled state, the likelihood that the nozzle 148 will either break during shipment, or pierce through the shipping container are reduced. Upon shipping the sealant container 120 and the nozzle 148, the nozzle 148 is then coupled to the sealant container 120, and specifically the housing 122. Preferably, the nozzle 148 is coupled to the sealant container 120 by the operator.

Figure 18A:
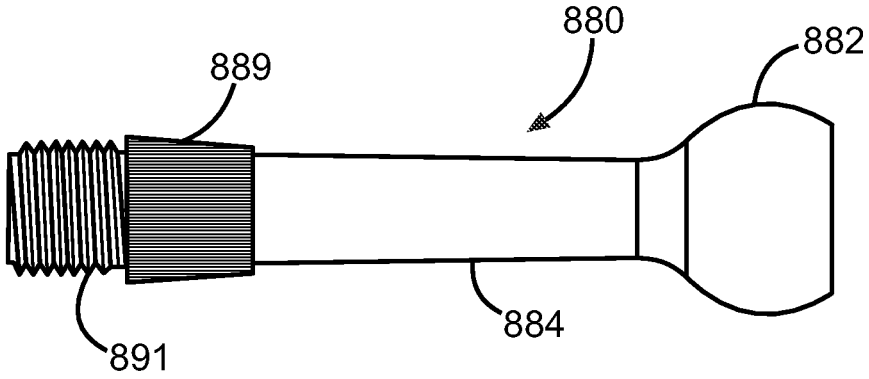
FIG. 18A depicts a side view of a base portion having a coupling member, in accordance with one embodiment of the present invention.
Figure 18B:
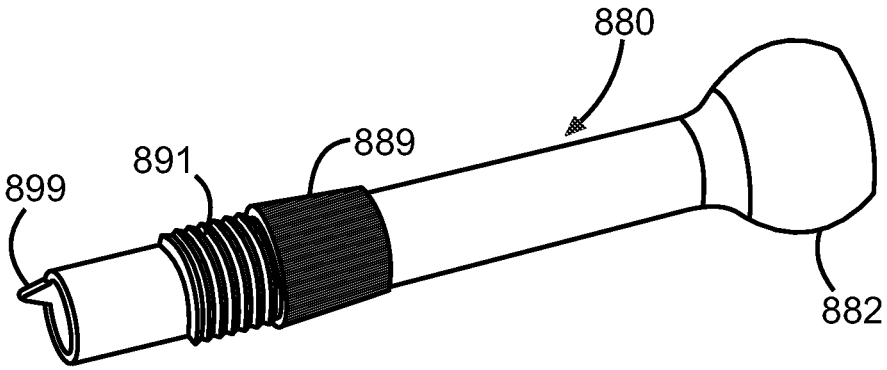
FIG. 18B depicts a side perspective view of a base portion having a coupling member connected with a piercing member, in accordance with one embodiment of the present invention.
Figure 19:
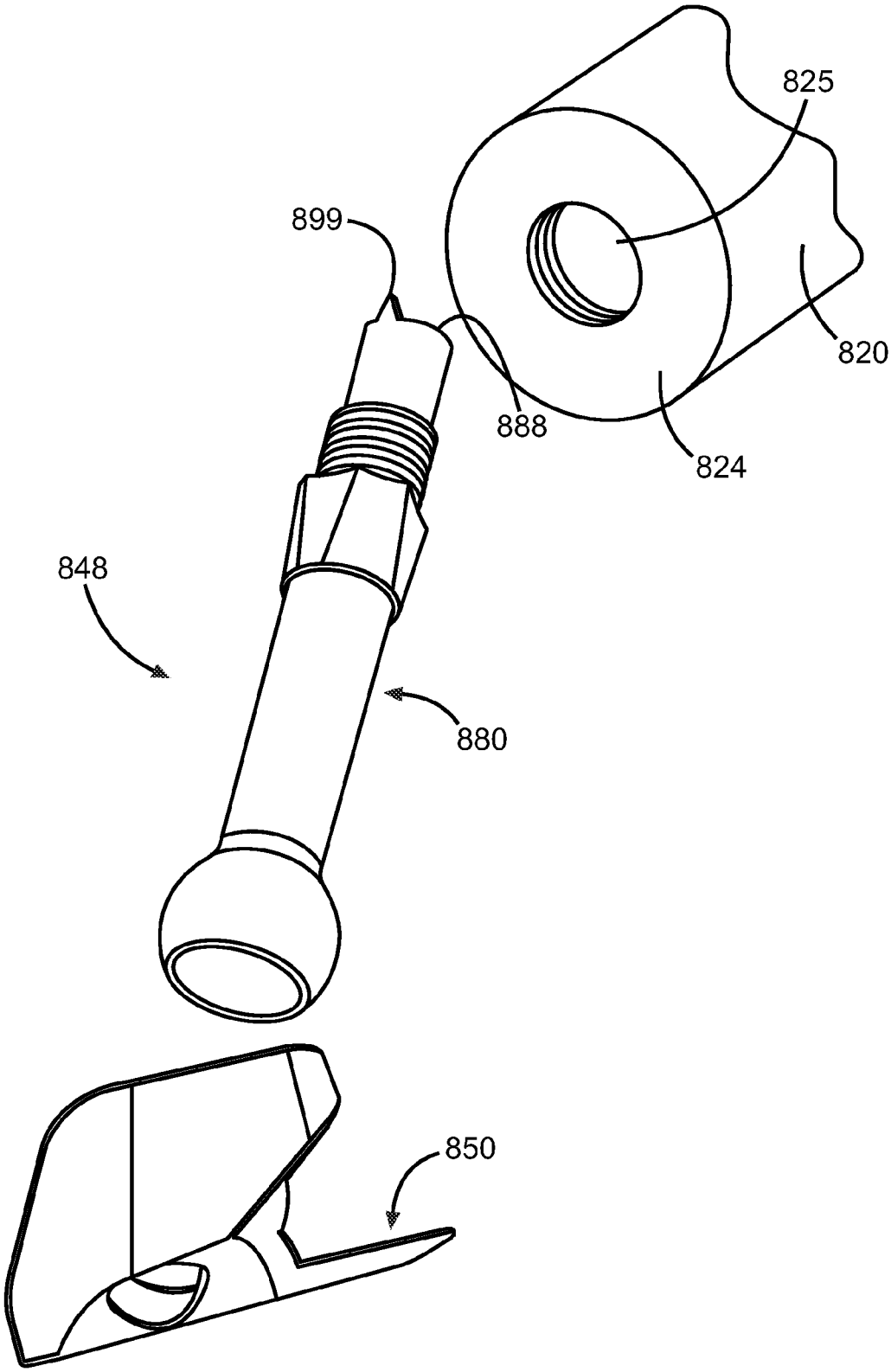
FIG. 19 depicts a side perspective view of a base portion having a coupling member connected with a piercing member, a nozzle head which may be coupled with a first end of the base portion, and a sealant container which may be coupled with an opposing end of the base portion, in accordance with one embodiment of the present invention.

Referring to FIGS. 18A, 18B, and 19, in one embodiment, a nozzle 848 is provided having a piercing member 899 at a bottom end 888 of a base portion 880. The piercing member 899 preferably forms a tip which is used to pierce through a top surface 824 of a sealant container 820 during the coupling of the nozzle 148 to the sealant container 120. Preferably, the top surface 824 includes a pierceable seal 825 through which the piercing member 899 is used to pierce. Preferably, the pierceable seal 825 has less tensile strength than the top surface 824, and is therefore easier to break through than the top surface 824. The pierceable seal 825 includes things such as a sheet of metal foil, a sheet of polymeric material, or a sheet of paper.

Figure 13:
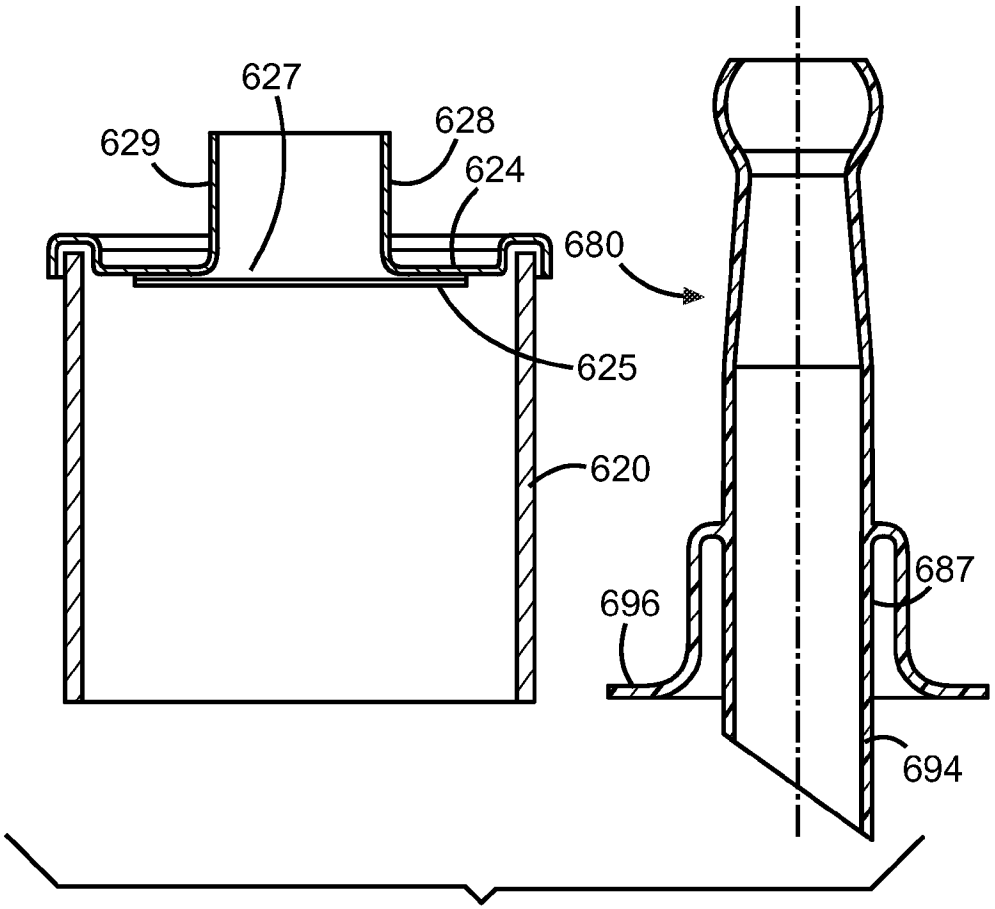
FIG. 13 depicts a cross-sectional view of the base portion shown in FIG. 12 and a sealant container forming a projection, in accordance with one embodiment of the present invention.
Figure 12:
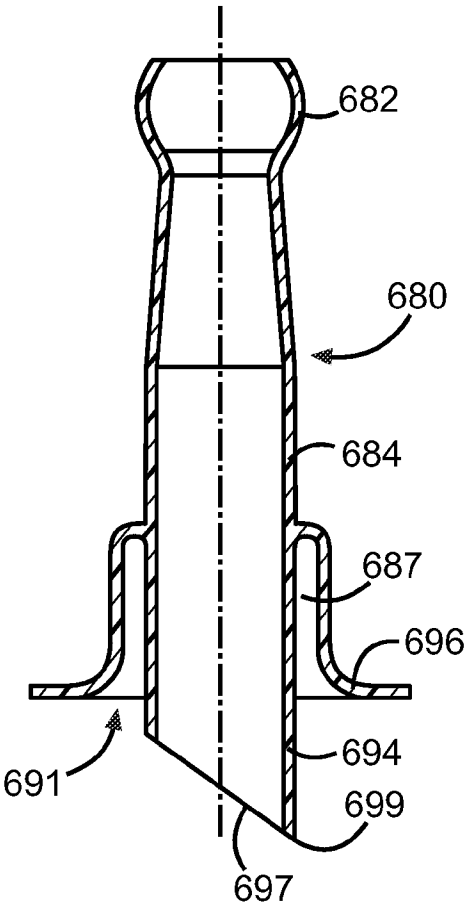
FIG. 12 depicts a cross-sectional view of a base portion having a curved flange, in accordance with one embodiment of the present invention.
Figure 14:
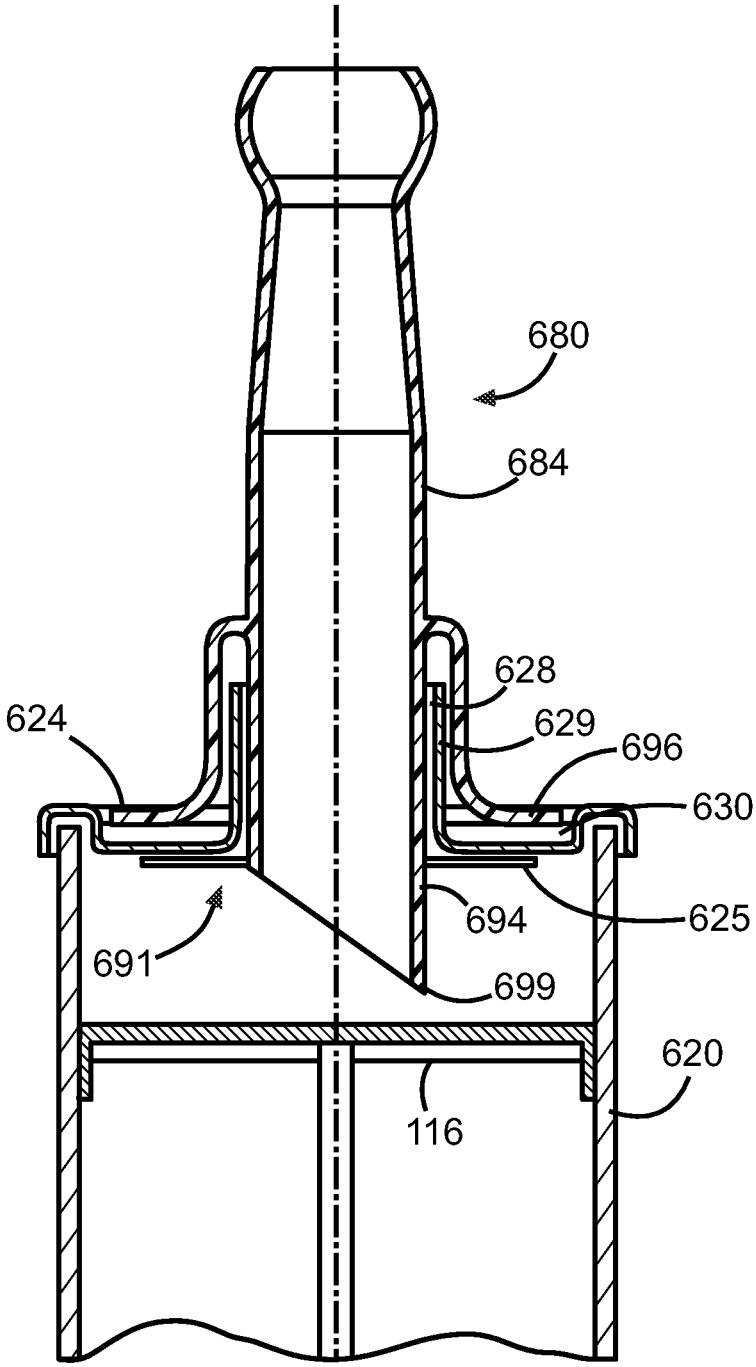
FIG. 14 depicts a cross-sectional view of the base portion and sealant container shown in FIG. 13, where the curved flange is connected with the projection, in accordance with one embodiment of the present invention.

Referring to FIGS. 12, 13, and 14, in one embodiment, a base portion 680 is provided having a piercing member 699 which forms an edge 697 that is angled and end in a tip which is preferably sharp. The piercing member 699 may be used to pierce top surface 624 of a sealant container 620, and preferably a pierceable seal 625 covering an opening 627 formed in the top surface 624, when the base portion 180 is coupled with the sealant container 120. When the sealant container 620 is emptied, via the sealant applicator 110, compression member 116 of the sealant applicator 110 advances forward and pushes against the piercing member 699. Pressure applied to the piercing member 699 from the compression member 116, is able to push the base portion 180 out of the sealant container 620, providing a visual indicator that the sealant container 620 is empty or nearly empty. Preferably, the base portion 680 includes a curved flanged member 696 which forms a cavity 687, and the sealant container 620 includes a second fastener 628 which extends away from the top surface 124, forming a projection 629. When coupling the sealant container 620 with the base portion 680, the projection 629 is inserted into the cavity 687, and the flanged member 696 is press fit over the projection and to the second fastener 628, as shown in FIG. 14.

Figure 16:
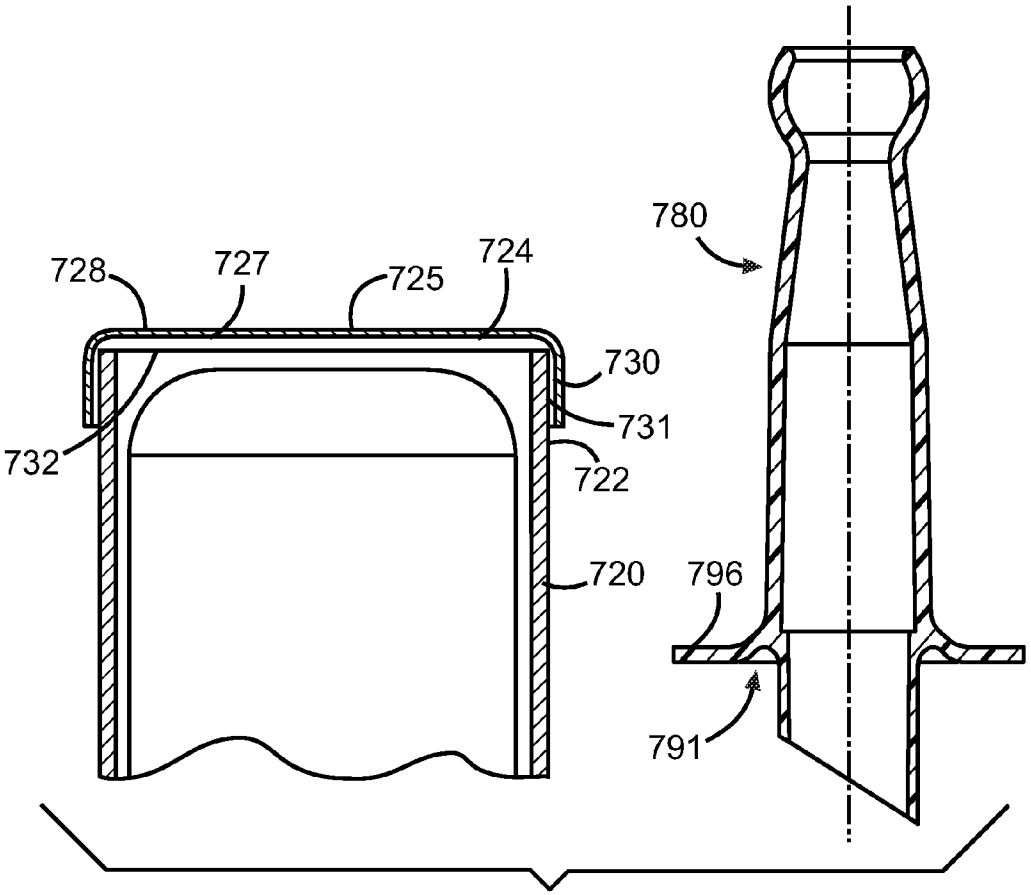
FIG. 16 depicts a cross-sectional view of the base portion shown in FIG. 15 and a sealant container forming an opening, in accordance with one embodiment of the present invention.
Figure 15:
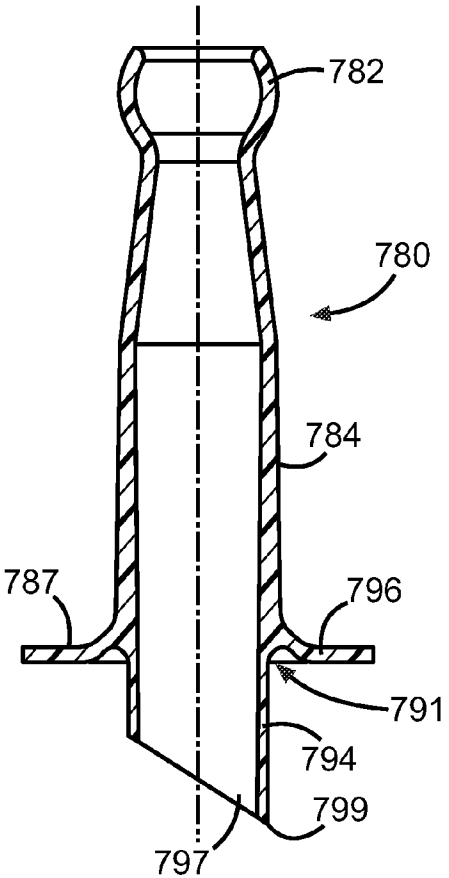
FIG. 15 depicts a cross-sectional view of a base portion having a flange, in accordance with one embodiment of the present invention.
Figure 17:
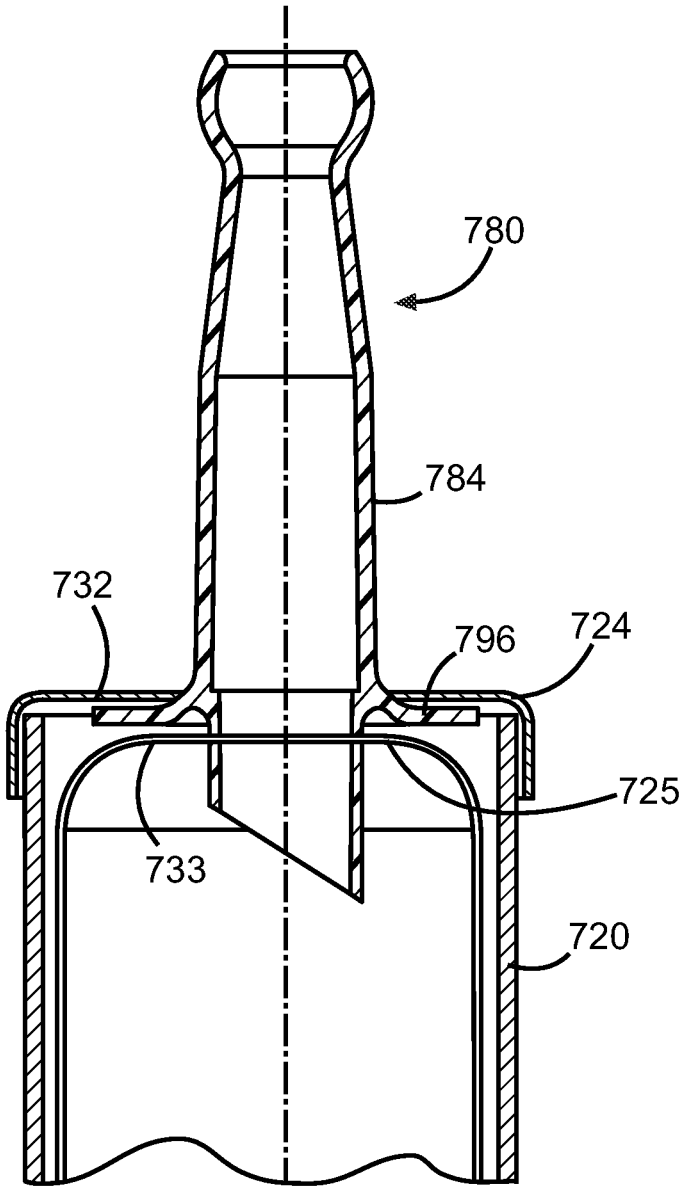
FIG. 17 depicts a cross-sectional view of the base portion and sealant container shown in FIG. 16, where the base portion is connected with the sealant container, in accordance with one embodiment of the present invention.

Referring to FIGS. 15, 16, and 17, a base portion 780 is provided having a piercing member 799 which forms an edge 797 that is angled and end in a tip which is preferably sharp. The base portion 680 includes a flanged member 796 which extends away from the base portion 680 and forms a disc 787. A sealant container 720 is provided which includes a second fastener 728 covering an open end of the sealant container 720. The second fastener 728 includes a top surface 724 having an opening 727, preferably covered by a pierceable seal 725. The second fastener 728 is preferably fastened to the housing 722 via threads 730, 731 on both the second fastener 728 and the housing 722, respectively.

When coupling the sealant container 720 with the base portion 780, the second fastener 728 is detached from the sealant container 720 and placed over the base portion 780 and the base portion 780 goes through the opening 727. If a pierceable seal 725 exists over the opening 727, the pierceable seal 725 is pierced by piercing member 799. With the flanged member 796 abutting an inner surface 732 of the second fastener 728, the second fastener 728 is fastened to the housing 722. The flanged member 796 is preferably seated between the inner surface 732 of the second fastener and an upper surface 733 formed within the sealant container 720 press fit over the projection and to the second fastener 628, as shown in FIG. 14. In one embodiment, the upper surface 733 forms a pierceable seal within the housing 722, which may be pierced by piercing member 799 when coupling the base portion 680 to the sealant container 720.

Figure 22:
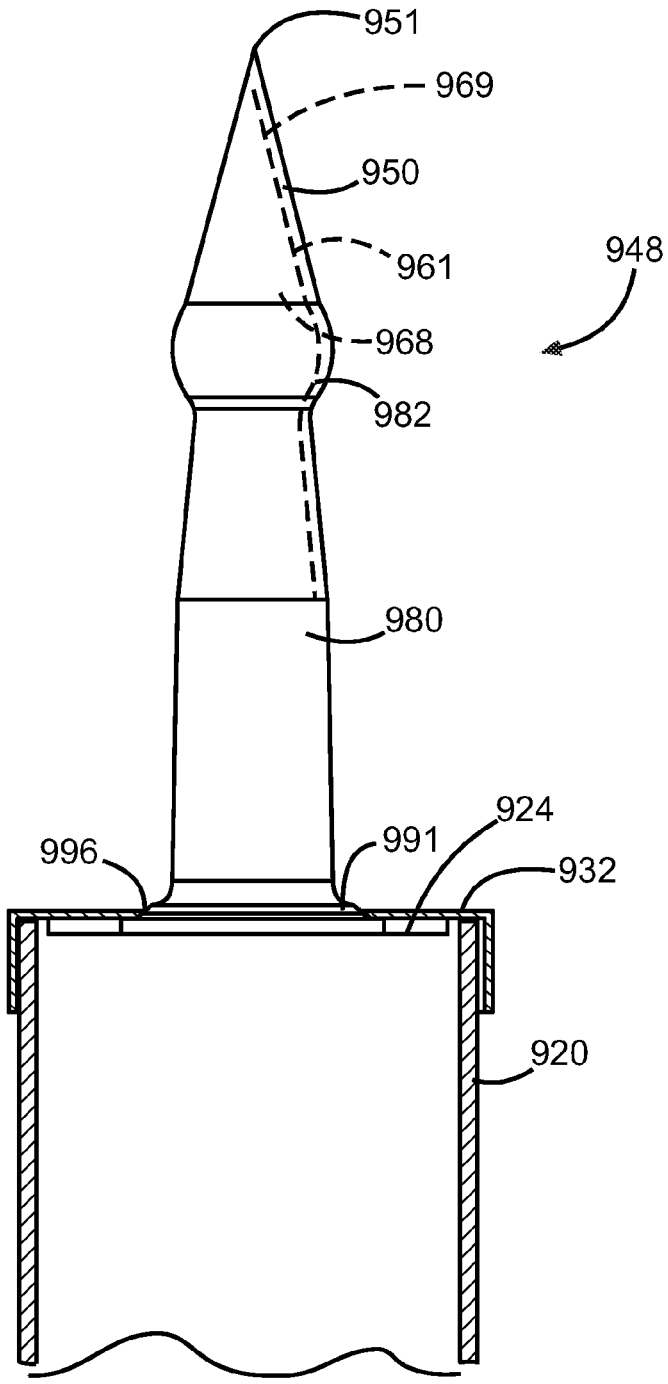
FIG. 22 depicts a side view of a nozzle having a base portion which includes a second coupler connected with a tip-shaped nozzle head.

Referring to FIG. 22, in one embodiment, a nozzle 948 is provided having a base portion 980 which includes a second coupler 982 connected with a tip-shaped nozzle head 950. The tip-shaped nozzle head 950 is preferably conically shaped and forms a tip 951. Preferably, the nozzle head includes a primary channel 961 having an entrance 968 and an exit 969. In one embodiment, the exit 969 of the primary channel 961 is sealed. In one embodiment, the nozzle 948 is conically shaped so that the cross sectional area of the entrance 968 is larger than the cross-sectional area of the exit 969. Preferably, the nozzle 948 includes a coupling member 991 comprising a flanged member 996 which mates with a securing cap 932 connected with a top surface 924 of sealant container 920.

Preferably, an operator trims the tip-shaped nozzle head 950 to form an opening through which sealant 100 is later dispensed, wherein the size of the opening is controlled by the operator and dependant on where the operator chooses to trim the tip-shaped nozzle head 950. Preferably the nozzle 948 is integrally formed as one-piece. Preferably, the nozzle 948 includes a second coupler 982 between the base portion 980 and the tip-shaped nozzle head 950. If the operator so chooses, the entire tip-shaped nozzle head 950 may be trimmed off, leaving only base portion 980 and second coupler 982, and allowing base portion 980 to be coupled with any nozzle head which has a complimentary coupling member for mating with second coupler 982.

Figure 11:
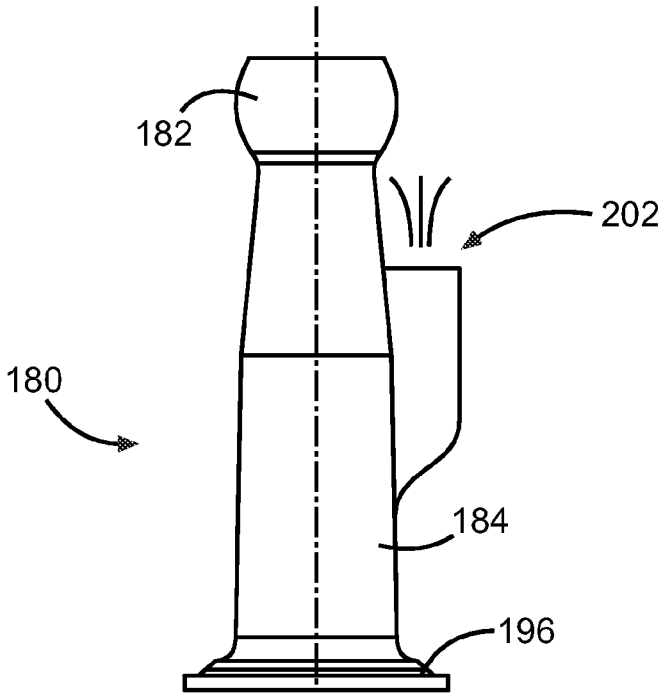
FIG. 11 depicts a side perspective view of a base portion of a nozzle having a light assembly, in accordance with one embodiment of the present invention.

In one embodiment, the nozzle 150 is molded from a reflective or fluorescent material to make the nozzle head 148 more visible when used in shadows or areas near first and second members 102, 104 that have poor lighting. Referring to FIG. 11, in one embodiment, nozzle 148 includes a light assembly 202 which emits light for better visibility. Preferably, the light assembly 202 is connected with the nozzle 148, and preferably the base portion 180. In one embodiment, the light assembly 202 is connected with the sealant container 120 or the sealant applicator 110. The light assembly 202 emits light to help increase the visibility of the gap 140 when applying sealant 100 into the gap, where natural lighting is poor.

In one embodiment, the nozzle head 148 or the base portion 180 includes a shut-off mechanism, such as a valve, which prevents the sealant applicator 110 from dripping sealant 100 when the operator stops dispensing, allowing fluid compressive energy to be stored in the sealant container 120. Various shut-off mechanisms could be used, such as an external check, a pinch, and a duck-bill valve to resist the residual pressure, or an internal check valve attached directly to the trigger 114 of sealant applicator 110, all of which would control the flow of sealant 100 from the nozzle head 150.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A nozzle head for dispensing sealant within a gap in an application direction, the nozzle head comprising:

a body section (159) forming a primary channel (161) through which the sealant is dispensed, the primary channel forming an entrance through which sealant enters the body section and an exit (169) through which sealant is dispensed from the nozzle head;

a port (160) connected with the body section (159) and surrounding the exit, the port forming a chamber (171) having a tip portion (165) opposed to a rear opening (164), wherein the chamber forms an angled path (162)

from the tip portion (165) to the rear opening (164) to trap and guide excess sealant dispensed from the nozzle head within the chamber from the tip portion out through the rear opening, wherein when the sealant is dispensed from the nozzle head within the gap in the application direction, the tip portion is located upstream from the exit and the rear opening is located downstream from the exit;

a nose (156) connected with the body section adjacent the tip portion, wherein the nose includes a first surface (157), and a second surface (158), wherein the first surface of the nose extends in a first plane and the second surface of the nose extends in a second plane, such that an engagement angle is formed between the first and second planes for bridging at least a portion of the gap and guiding sealant into the gap; and first and second wings (152,154) extending from opposing sides of the port for bridging the gap, wherein the first wing is connected with the second wing to form the tip portion.

2. The nozzle head of claim 1, wherein the gap is formed between a first member and a second member, and wherein the first and second wings sealingly engage the first and second members.

3. The nozzle head of claim 1, wherein the engagement angle is between 10 degrees and 180 degrees.

4. The nozzle head of claim 1 further comprising a first coupler connected with the body section, wherein the first coupler is formed around the entrance to the primary channel.

5. The nozzle head of claim 1 further comprising a nose connected with the body section adjacent the tip portion, wherein the nose includes a first surface for bridging at least a portion of the gap and guiding sealant into the gap.

6. A nozzle head for dispensing sealant within a gap in an application direction, the nozzle head comprising:

a body section (159) forming a primary channel (161) through which the sealant is dispensed in a dispensation direction, the primary channel forming an entrance through which sealant enters the body section and an exit (169) through which the sealant is dispensed from the nozzle;

at least one port (360,363) connected with the body section and surrounding the exit, the at least one port forming a chamber (171) having a tip portion opposed to a first rear opening (164, 364), wherein the chamber configured to trap excess sealant at the tip portion and guide excess sealant to the first rear opening, wherein the chamber forms a second rear opening (367) adjacent the first rear opening (364), which is adapted for more excess sealant to flow therethrough;

a nose (156) connected with the body section located a first distance away from the exit, opposite the application direction and along the dispensation direction, wherein the nose includes a first surface (157), and a second surface (158) connected with the first surface at first angle ($\alpha$) for bridging at least a portion of the gap and guiding sealant into the gap; and first and second wings (352,354) extending from opposing sides of the port for bridging the gap, wherein the first wing is connected with the second wing at the tip portion.

7. The nozzle of claim 6, wherein the nose includes a second surface connected with the first surface at an angle less than 180 degrees.

8. The nozzle of claim 6, further comprising first and second wings extending from opposing sides of the nose and the port.

9. The nozzle of claim 8, wherein the gap is formed between a first member and a second member, and wherein the first and second wings sealingly engage the first and second members.

10. The nozzle of claim 8, wherein a first surface of the first wing extends in a first plane and a second surface of the second wing extends in a second plane, and wherein an engagement angle is formed between the first and second planes, and wherein the engagement angle is between 10 degrees and 180 degrees.

11. The nozzle of claim 6, further comprising a base portion coupled with the body section, the base portion forming a secondary channel which is in fluid communication with the primary channel.

12. The nozzle of claim 11, wherein the base portion is movably coupled with the body section.

13. The nozzle of claim 12, wherein the body section comprises a first coupler surrounding the entrance to the primary channel, the base portion comprises a second coupler surrounding an exit of the secondary channel, and wherein the first coupler matingly engages the second coupler.

* * * * *